US008714254B2

(12) United States Patent
Harrison et al.

(10) Patent No.: US 8,714,254 B2
(45) Date of Patent: May 6, 2014

(54) METHOD FOR MIXING FLUIDS DOWNHOLE

(75) Inventors: Christopher Harrison, Auburndale, MA (US); Michael O'Keefe, Melbourne (AU); Ronald van Hal, Watertown, MA (US); Jimmy Lawrence, Cambridge, MA (US); Oliver C. Mullins, Ridgefield, CT (US)

(73) Assignee: Schlumberger Technology Corporation, Sugar Land, TX (US)

( * ) Notice: Subject to any disclaimer, the term of this patent is extended or adjusted under 35 U.S.C. 154(b) by 471 days.

(21) Appl. No.: 12/966,464

(22) Filed: Dec. 13, 2010

(65) Prior Publication Data

US 2012/0145400 A1 Jun. 14, 2012

(51) Int. Cl.
*E21B 49/08* (2006.01)
*E21B 43/22* (2006.01)

(52) U.S. Cl.
USPC ..... 166/305.1; 175/50

(58) Field of Classification Search
CPC ..... E21B 43/16; E21B 43/34; E21B 49/00; E21B 49/08; E21B 49/081; E21B 49/085; E21B 49/10; B01F 11/0082; B01F 13/0016; B01F 13/0018
USPC ..... 166/305.1, 69; 175/50, 59; 73/152.23, 73/152.55; 436/28
See application file for complete search history.

(56) References Cited

U.S. PATENT DOCUMENTS

| | | | |
|---|---|---|---|
| 3,174,547 | A | 3/1965 | Fields |
| 3,212,576 | A | 10/1965 | Lanmon, II |
| 3,329,204 | A | 7/1967 | Brieger |
| 3,347,314 | A | 10/1967 | Schuster |
| 3,347,315 | A | 10/1967 | Lanmon, II |
| 3,347,322 | A | 10/1967 | Lanmon, II |
| 3,394,767 | A | 7/1968 | Terry |
| 3,507,340 | A | 4/1970 | Voetter |
| 3,731,876 | A | 5/1973 | Showalter |
| 3,859,851 | A | 1/1975 | Urbanosky |
| 4,353,508 | A | 10/1982 | Butterfield et al. |

(Continued)

FOREIGN PATENT DOCUMENTS

| | | |
|---|---|---|
| EP | 2021769 | 2/2009 |
| WO | 2007143474 | 12/2007 |

OTHER PUBLICATIONS

Burgess et al. Formation Testing and Sampling Through Casting; Oilfield Review, Spring 2002 (12 pages).

*Primary Examiner* — Daniel P Stephenson

(74) *Attorney, Agent, or Firm* — Jakub M. Michna; Bridget Laffey

(57) ABSTRACT

Methods and devices for mixing a first fluid with a second fluid downhole include a chamber having a first end, a second end and an opening for fluid to flow there through. A top surface of a piston is capable of contacting the second end of the chamber. The piston is located at a first position within the chamber based upon characteristics of a second fluid. A fluid delivery system supplies the first fluid and supplies a second fluid through a first opening of the chamber, wherein the second fluid is at a pressure that moves the piston approximate to the second end of the chamber. The piston includes an agitator mixing device that is attached to a bottom surface of the piston, wherein mixing of the first fluid with the second fluid primarily occurs upon movement of the piston by actuating device.

34 Claims, 9 Drawing Sheets

(56) References Cited

U.S. PATENT DOCUMENTS

| | | | | |
|---|---|---|---|---|
| 4,860,581 | A | 8/1989 | Zimmerman et al. | |
| 4,923,121 | A | 5/1990 | Boyer | |
| 4,994,671 | A | 2/1991 | Safinya et al. | |
| 5,104,527 | A | 4/1992 | Clinkenbeard | |
| 5,266,800 | A | 11/1993 | Mullins | |
| 5,273,190 | A | 12/1993 | Lund | |
| 5,337,822 | A | 8/1994 | Massie et al. | |
| 5,939,717 | A | 8/1999 | Mullins | |
| 6,027,043 | A | 2/2000 | Rosenberg | |
| 6,402,364 | B1 | 6/2002 | Esclar et al. | |
| 6,612,295 | B2 | 9/2003 | Lerner | |
| 6,719,729 | B2 | 4/2004 | Sogaro | |
| 6,995,360 | B2 | 2/2006 | Jones et al. | |
| 7,025,138 | B2 | 4/2006 | Kurkjian et al. | |
| 7,118,349 | B2 | 10/2006 | Oglesby | |
| 7,511,819 | B2 | 3/2009 | DiFoggio | |
| 7,516,654 | B2 | 4/2009 | DiFoggio | |
| 7,523,648 | B2 | 4/2009 | Zougari | |
| 7,614,294 | B2 | 11/2009 | Hegeman et al. | |
| 7,814,782 | B2 | 10/2010 | DiFoggio | |
| 7,937,223 | B2 | 5/2011 | Ciglenec et al. | |
| 7,959,864 | B2 | 6/2011 | Jiang et al. | |
| 8,032,303 | B2 | 10/2011 | Fujisawa et al. | |
| 8,039,791 | B2 | 10/2011 | Dong et al. | |
| 8,056,408 | B2 | 11/2011 | Pop et al. | |
| 8,058,071 | B2 | 11/2011 | Jiang et al. | |
| 8,068,226 | B2 | 11/2011 | Csutak | |
| 8,082,780 | B2 | 12/2011 | Vannuffelen et al. | |
| 8,165,817 | B2 | 4/2012 | Betancourt et al. | |
| 8,379,207 | B2 | 2/2013 | DiFoggio et al. | |
| 8,518,702 | B2 | 8/2013 | Jiang et al. | |
| 2002/0087122 | A1 | 7/2002 | Sogaro | |
| 2003/0134426 | A1 | 7/2003 | Jiang et al. | |
| 2005/0056313 | A1 | 3/2005 | Hagen et al. | |
| 2008/0041593 | A1* | 2/2008 | Brown et al. | 166/302 |
| 2008/0066904 | A1 | 3/2008 | van Hal et al. | |
| 2008/0111064 | A1 | 5/2008 | Andrews et al. | |
| 2009/0126996 | A1 | 5/2009 | Villareal et al. | |
| 2009/0285721 | A1 | 11/2009 | DeGreeve et al. | |
| 2009/0302221 | A1 | 12/2009 | Tavernier et al. | |
| 2010/0000731 | A1 | 1/2010 | Gordon et al. | |
| 2010/0132450 | A1 | 6/2010 | Pomerantz et al. | |
| 2010/0147065 | A1 | 6/2010 | Tan et al. | |
| 2010/0170718 | A1* | 7/2010 | Villareal et al. | 175/50 |
| 2010/0181472 | A1 | 7/2010 | Csutak | |
| 2011/0023594 | A1 | 2/2011 | Pelletier et al. | |
| 2012/0137764 | A1 | 6/2012 | Lawrence et al. | |
| 2012/0138364 | A1 | 6/2012 | Leonard et al. | |
| 2012/0145400 | A1 | 6/2012 | Harrison et al. | |
| 2012/0149117 | A1 | 6/2012 | Lawrence et al. | |
| 2012/0149604 | A1 | 6/2012 | Lawrence et al. | |
| 2012/0199365 | A1 | 8/2012 | Patel et al. | |
| 2012/0273203 | A1 | 11/2012 | Lawrence et al. | |
| 2012/0276648 | A1 | 11/2012 | van Hal et al. | |
| 2013/0020077 | A1 | 1/2013 | Irani et al. | |
| 2013/0056626 | A1 | 3/2013 | Shen et al. | |
| 2013/0071934 | A1* | 3/2013 | Indo et al. | 436/28 |
| 2013/0075093 | A1 | 3/2013 | van Hal et al. | |
| 2013/0104642 | A1 | 5/2013 | Pelletier et al. | |
| 2013/0118734 | A1 | 5/2013 | Csutak | |
| 2013/0188169 | A1 | 7/2013 | Harrison et al. | |

* cited by examiner

METHOD FOR MIXING FLUIDS DOWNHOLE

CROSS REFERENCE TO RELATED APPLICATION(S)

This patent application is related to commonly owned United States Patent Applications: 1) U.S. patent application Ser. No. 61/422,637 titled "CHEMICAL SCAVENGER FOR DOWNHOLE CHEMICAL ANALYSIS" by Jimmy Lawrence et al.; 2) U.S. patent application Ser. No. 12/966,451 titled "HYDROGEN SULFIDE ($H_2S$) DETECTION USING FUNCTIONALIZED NANOPARTICLES" by Jimmy Lawrence et al.; 3) U.S. patent application Ser. No. 12/966,492 titled "A DOWNHOLE MIXING DEVICE FOR MIXING A FIRST FLUID WITH A SECOND FLUID" by Jimmy Lawrence et al.

FIELD

The disclosed subject matter is generally relates to mixing a first fluid with a second fluid in a subterranean environment. More particularly, the disclosed subject matter of this patent specification relates to mixing the first fluid such as a reagent fluid with the second fluid such as formation fluid that is a compressible fluid, wherein at least embodiment includes the reagent fluid as a liquid and the formation fluid as a gas.

BACKGROUND

Mixing fluids with a reliable efficiency in downhole tools is an important process to manipulate downhole fluids, for example one of many purposes may include gas scrubbing and/or colorimetric sensing.

There are various downhole tools such as the MDT and the CHDT (trademarks of Schlumberger) tools that can be useful in obtaining and analyzing fluid samples. The downhole tools such as the MDT tool (see, e.g., U.S. Pat. No. 3,859,851 to Urbanosky, and U.S. Pat. No. 4,860,581 to Zimmerman et al., which are hereby incorporated by reference herein in their entireties) typically include a fluid entry port or tubular probe cooperatively arranged within wall-engaging packers for isolating the port or probe from the borehole fluids. It is noted they also include sample chambers which can be coupled to the fluid entry by a flow line having control valves arranged therein.

However there is no known method offering an exact mixing volume between two components in a downhole mixing process, which indicates a need within the industries, by non-limiting example, the oilfield application industry. It is noted that for some industries (including the oil field application industry), technologies where emulsions, nanoparticles, microcapsules are involved it is critical to obtain quantitative measurements, as well as having a controlled mixing process with minimum contamination.

Therefore it is necessary to devise methods and devices to overcome at least the above discussed challenges and other technological challenges related to mixing fluids in a subterranean environment.

SUMMARY

The present disclosed subject matter relates to a downhole apparatus for mixing a first fluid with a second fluid in a subterranean environment. The downhole mixing apparatus includes a chamber having a first end, a second end and at least two openings, wherein the at least two openings allow fluid to flow there through. At least one piston having at least one agitator mixing device attached to a bottom surface of the at least one piston. A fluid delivery system for supplying: (1) a known volume of the first fluid to the chamber through a first opening of the at least two openings, the first fluid is in contact with the bottom surface of the piston; (2) a third fluid to the chamber through a second opening of the at least two openings, the third fluid is in contact with the top surface of the at least one piston and positions the at least one piston in a first position within the chamber, wherein the first position is dependent upon the characteristics of a second fluid; and (3) the second fluid is supplied to the chamber from the first opening at a pressure that partially mixes the fluids and moves the at least one piston from the first position to a second position approximate the second end of the chamber, resulting in pushing the third fluid through the second opening and out of the chamber. The downhole mixing apparatus further includes a actuating device of the fluid delivery system that applies a first pressure to the top surface of the piston, which movies the at least one piston in a direction from the second end toward the first end of the chamber. Wherein the actuating device applies a second pressure reversing the direction of movement of the at least one piston from the first end toward the second end of the chamber, wherein the movement of the at least one piston agitates the fluids with the at least one agitator mixing device to mix the first fluid with the second fluid. It is noted that the fluid may include one of air, a gas, a liquid or some combination thereof. Further, it is noted the actuating device may be one of a fluidized system including valves or a mechanical device.

According to aspects of the subject matter disclosed, the first fluid can be a reactant fluid that is from the group consisting of one of $H_2S$ detection, $CO_2$ detection, Hg detection or one or more molecule of the second fluid. Further, the second fluid can be a formation fluid that is one of a gas, a liquid or some combination thereof. Further still, the at least one agitator mixing device can be one of linear, non-linear or both that includes at least one perforated portion. It is possible According to aspects of the subject matter disclosed, the at least one agitator mixing device can be one of geometric shape such as a tree shaped, a T-shaped, a perforated cup with a shaft extending along vertical axis, a plurality of sequencing sized perforated cups varying from a smaller diameter to a larger diameter along a central axis, or non-geometric shape such as a perforated cavity having wave-like flare outward ends extending away from a central axis. Further, at least one agitator mixing device can include at least two arm extensions from at least one extension, wherein at least one arm extension of the at least two arm extension is one of perforated, partially angled, or some combination thereof. Further still, the at least one piston, the at least one agitator mixing device or some combination thereof include one or more coatings, such as at least one coating is capable for manipulation of the second fluid containing hydrogen sulfide ($H_2S$). It is possible, the at least one agitator mixing device can have at least a portion having one or more channels to assist in mixing the fluids or the at least one agitator mixing device can have at least one portion that is flexible. It is noted that the at least one agitator mixing device can be one of unitary or detachable to the at least one piston.

According to aspects of the subject matter disclosed, the downhole mixing apparatus can be used for one of a gas scrubbing, a colorimetric sensing measurement, downhole measurements such as electrochemical sensing or magnetic resonance sensing.

According to aspects of the subject matter disclosed, the fluid delivery system can be in communication with a downhole tool having an inlet disposed on an exterior of the downhole tool for engaging a formation in the subterranean environment, the downhole tool has a tool chamber fluidly connected to the inlet, so a test fluid is disposed in the tool chamber, the tool chamber containing the test fluid is fluidly connected to the chamber wherein the test fluid is capable of being the second fluid. Further, the fluid delivery system can have a plurality of valves in communication with each opening of the two or more openings, the first opening has a first valve, a second valve and third valve of the plurality of valves and the second opening has a fourth valve, a fifth valve and a sixth valve. For example, it is possible the actuating device is pumping device that applies multiple pressures against the at least one piston, such as the first pumping pressure directs the at least one piston toward the first end using the first, second and third valves and the second pumping pressure directs the at least one piston in a reverse direction from the first end toward the second end of the chamber using the third, fourth, fifth and sixth valves. Further still, the downhole mixing apparatus may further comprise a second piston of the at least one piston, the second piston capable of contacting the top surface of the piston and includes at least one magnet to identify a location of the at least one piston during the mixing of the first fluid with the second fluid.

According to aspects of the subject matter disclosed, the downhole mixing apparatus may further comprise at least one sealing device for the at least one piston, wherein the sealing device is from the group consisting of one of at least one o-ring or one or more elastomeric device. The actuating device may be a pumping device that compresses the fluid mixture by applying a first pumping pressure to the top surface of the piston using the second fluid, moving the at least one piston in a direction from the second end toward the first end of the chamber, the pumping device applies a second pumping pressure reversing the direction of movement of the at least one piston from the first end toward the second end of the chamber, wherein the movement of the at least one piston agitates the fluids with the at least one agitator mixing device to mix the first fluid with the second fluid. It is possible the characteristics of the second fluid can provide for a maximum volume of the first fluid, the maximum volume of the first fluid is configured by a volume change upon compression of the second fluid. Also, it is possible the actuating device can be one of a mechanical actuating device or a pumping device.

In accordance with another embodiment of the disclosed subject matter, a downhole mixing method for mixing a first fluid with a pressurized second fluid. The downhole mixing method includes: (a) positioning within the chamber at least one piston having at least one agitator mixing device attached to a bottom surface of the at least one piston; (b) using a fluid delivery system for supplying: (1) a known volume of the first fluid into a first end of the chamber through a first opening of two or more openings in the chamber, the first fluid is in contact with the bottom surface of the piston; (2) a third fluid through a second opening of the at least two openings by the fluid delivery system, the third fluid is in contact with the top surface of the at least one piston and positions the at least one piston at a first piston, wherein the first position is dependent upon the characteristics of the second fluid; and (3) the pressurized second fluid in the first opening at a pressure that partially mixes the fluids by the fluid delivery system, and moves the at least one piston from the first position to a second position approximate the second end of the chamber, resulting in pushing the third fluid through the second opening and out of the chamber; (c) actuating with a actuating device of the fluid delivery system to applying a first pressure to the top surface of the piston through the second opening, moving the at least one piston in a direction from the second end toward the first end of the chamber, the actuating device applies a second pressure reversing the direction of movement of the at least one piston from the first end toward the second end of the chamber, wherein the movement of the at least one piston agitates the fluids using the at least one agitator mixing device to mix the first fluid with the second fluid; and (d) repeating step (c) one or more times According to aspects of the subject matter disclosed, step (d) further comprises a downhole tool for housing the chamber wherein the exiting fluid mixture is in communication via a fluid mixture flow line, the fluid mixture is introduced with at least one external detector located in the downhole tool. Further, step (d) includes the first fluid and the second fluid exiting the chamber as a homogenous fluid. Further still, the characteristics of the second fluid may provide for a maximum volume of the first fluid, the maximum volume of the first fluid is configured by a volume change upon compression of the second fluid. It is possible step (b) may include the first fluid is a reagent fluid and the second fluid is a formation fluid, and the agitation by the at least one agitator results in a larger surface for the reagent fluid to react with the formation fluid. It is noted that steps (c) and (d) can provide for one of an increase in a surface to volume ratio of the first fluid to significantly increase reaction or mixing with the second fluid, a manipulation of the fluid mixture properties such as a compound extraction or a compound stripping of the second fluid by the first fluid occurs.

According to aspects of the subject matter disclosed, the second fluid can be a formation fluid that is one of a gas, a liquid or some combination thereof. The fluid delivery system can be in communication a downhole tool having an inlet disposed on an exterior of the downhole tool for engaging a formation in a subterranean environment, the downhole tool having a tool chamber fluidly connected to the inlet, so a test fluid is disposed in the tool chamber which is capable of being used as the second fluid that is capable of being introduced to the chamber. The at least one piston may have at least one sealing device, wherein the at least one sealing device is from the group consisting of one of at least one o-ring or one or more elastomeric device. The chamber, the at least one piston, the at least one agitator mixing device or some combination thereof can be coated with one or more coatings, such as at least one coating capable manipulating the second fluid containing hydrogen sulfide ($H_2S$). The fluid delivery system can have a plurality of valves in communication with each opening of the two or more openings, the first opening has a first valve, a second valve and third valve of the plurality of valves and the second opening has a fourth valve, a fifth valve and a sixth valve.

According to aspects of the subject matter disclosed, the actuating device can be a pumping device that applies multiple pressures against the at least one piston, such as the first pumping pressure directs the at least one piston toward the first end using the first, second and third valves and the second pumping pressure directs the at least one piston in a reverse direction from the first end toward the second end of the chamber using the third, fourth, fifth and sixth valves. The actuating device can be a pumping device that pumps to compress the fluid mixture by applying a first pumping pressure to the top surface of the piston with the second fluid through the second opening, moving the at least one piston in a direction from the second end toward the first end of the chamber, the pumping device applies a second pumping pressure reversing the direction of movement of the at least one piston from the first end toward the second end of the chamber, wherein the movement of the at least one piston agitates the fluids using the at least one agitator mixing device to mix the first fluid with the second fluid.

Further features and advantages of the disclosed subject matter will become more readily apparent from the following detailed description when taken in conjunction with the accompanying Drawings.

BRIEF DESCRIPTION OF THE DRAWINGS

The present disclosed subject matter is further described in the detailed description which follows, in reference to the noted plurality of drawings by way of non-limiting examples of exemplary embodiments of the present disclosed subject matter, in which like reference numerals represent similar parts throughout the several views of the drawings, and wherein.

DETAILED DESCRIPTION OF THE PREFERRED EMBODIMENTS

Figure 1:
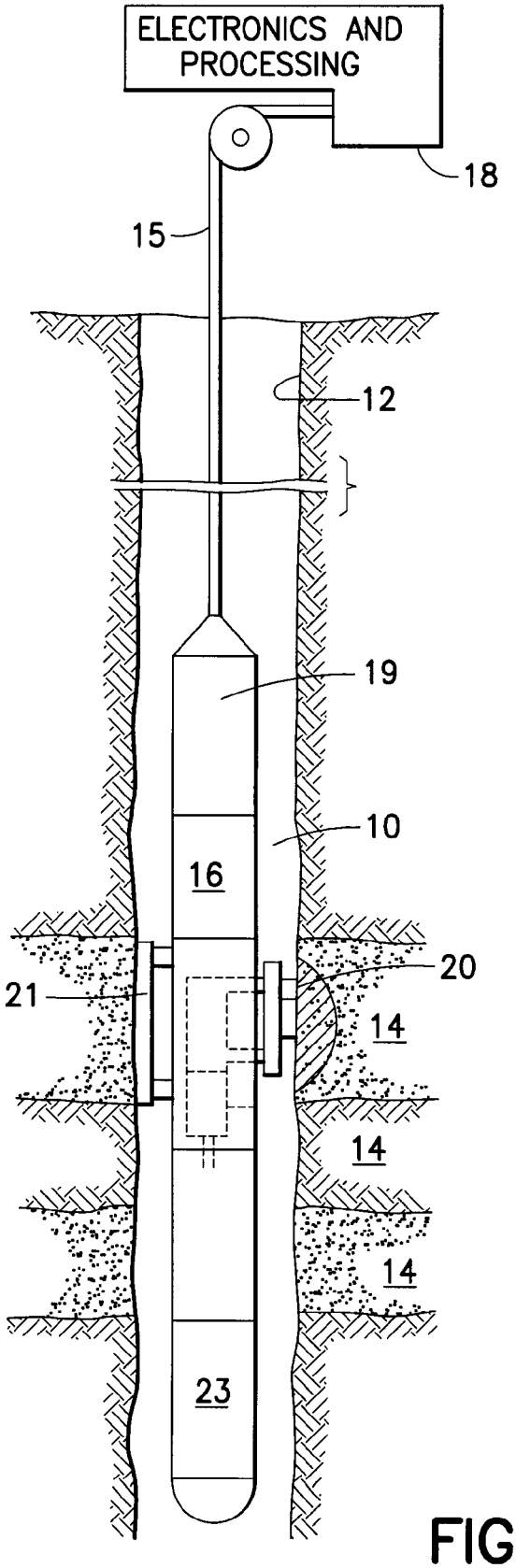
FIG. 1 shows a prior art schematic diagram showing a downhole/borehole tool with an sampling port.

The particulars shown herein are by way of example and for purposes of illustrative discussion of the embodiments of the present disclosed subject matter only and are presented in the cause of providing what is believed to be the most useful and readily understood description of the principles and conceptual aspects of the present disclosed subject matter. In this regard, no attempt is made to show structural details of the present disclosed subject matter in more detail than is necessary for the fundamental understanding of the present disclosed subject matter, the description taken with the drawings making apparent to those skilled in the art how the several forms of the present disclosed subject matter may be embodied in practice. Further, like reference numbers and designations in the various drawings indicated like elements.

The present disclosed subject matter relates to a downhole mixing apparatus for mixing a first fluid with a second fluid in a subterranean environment. The downhole mixing apparatus includes a chamber having a first end, a second end and at least two openings, wherein the at least two openings allow fluid to flow there through. At least one piston having at least one agitator mixing device attached to a bottom surface of the at least one piston. A fluid delivery system for supplying: (1)

a known volume of the first fluid to the chamber through a first opening of the at least two openings, the first fluid is in contact with the bottom surface of the piston; (2) a third fluid to the chamber through a second opening of the at least two openings, the third fluid is in contact with the top surface of the at least one piston and positions the at least one piston in a first position within the chamber, wherein the first position is dependent upon the characteristics of a second fluid; and (3) the second fluid is supplied to the chamber from the first opening at a pressure that partially mixes the fluids and moves the at least one piston from the first position to a second position approximate the second end of the chamber, resulting in pushing the third fluid through the second opening and out of the chamber. The downhole mixing apparatus further includes a actuating device of the fluid delivery system that applies a first pressure to the top surface of the piston, which movies the at least one piston in a direction from the second end toward the first end of the chamber. Wherein the actuating device applies a second pressure reversing the direction of movement of the at least one piston from the first end toward the second end of the chamber, wherein the movement of the at least one piston agitates the fluids with the at least one agitator mixing device to mix the first fluid with the second fluid. It is noted that the fluid may include one of air, a gas, a liquid or some combination thereof.

Further, the subject matter disclosed relates to methods and devices (or apparatuses) mixing a first fluid such as a reagent fluid with a second fluid such as formation fluid in a downhole environment, wherein at least embodiment includes the reagent fluid as a liquid and the formation fluid as a gas. For example, the mixing process will likely be in a tool such as a downhole tool, but other possible devices may be considered. Further, the subject matter disclosed provides many advantages, by non-limiting example, an advantage of mixing downhole fluids effectively in downhole tools. Formation gas or formation liquid can be transferred in to a sample bottle (MPSR) in Schlumberger MRMS Module of the Modular Dynamics Tester (MDT). Another possible advantage, among the many advantages, is that the methods and devices can improve the surface area available for mixing of two fluids (gas-liquid, liquid-liquid, liquid-gas) in a bottle. It is noted that a bottle can be considered a cavity, chamber or any device able to hold fluids.

Regarding the downhole tools and methods which expedite the sampling of formation hydrocarbons, the downhole tools, i.e., sampling tools, are utilized to carry downhole the mixing device(s) of the subject matter disclosed in this application. By way of example and not limitation, tools such as the previously described MDT tool of Schlumberger (see, e.g., previously incorporated U.S. Pat. No. 3,859,851 to Urbanosky, and U.S. Pat. No. 4,860,581 to Zimmerman et al.) with or without OFA, CFA or LFA module (see, e.g., previously incorporated U.S. Pat. No. 4,994,671 to Safinya et al., U.S. Pat. No. 5,266,800 to Mullin, U.S. Pat. No. 5,939,717 to Mullins), or the CHDT tool (see, e.g., previously incorporated "Formation Testing and Sampling through Casing", Oilfield Review, Spring 2002) may be utilized. An example of a tool having the basic elements to implement the invention is seen in schematic in FIG. 1.

Figure 4:
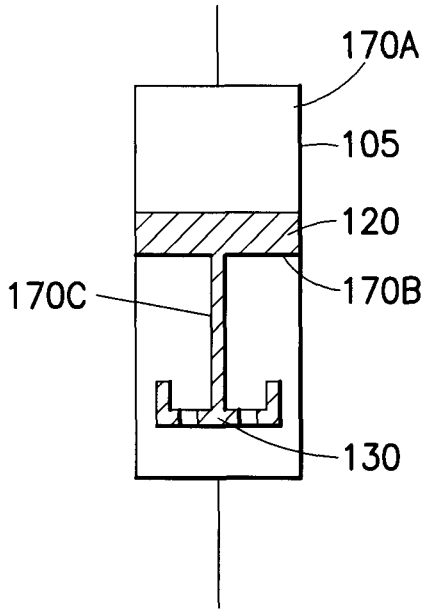
FIG. 4 shows the chamber, the at least one piston, the at least one agitator mixing device or some combination thereof having one or more coatings, such as at least one coating is capable for manipulation of the second fluid containing hydrogen sulfide ($H_2S$), according to embodiments of the disclosed subject matter.

The subject matter disclosed in the application discloses an apparatus and method to mix downhole fluids effectively in downhole tools. Formation gas or formation liquid can be transferred in to a sample bottle (MPSR) in Schlumberger MRMS Module of the Modular Dynamics Tester (MDT) as noted above. It is noted that the formation fluid is a compressible fluid. Further, the apparatuses and methods can improve the surface area available for mixing of two fluids (gas-liquid, liquid-liquid, liquid-gas) in the bottle, i.e., chamber. Once the formation fluid is captured, the formation fluid is mixed with a known volume of reagent that has been previously loaded into a chamber, i.e., sample bottle, in a downhole tool at surface (see FIG. 1). In order to expose the reagent fluid to the formation fluid, a valve configuration is changed and the formation fluid is pumped into the chamber that had been pre-filled with a known volume of the reagent (see FIG. 2). FIGS. 3-4 show the two steps involved with mixing the formation fluid and reagent, which involves switching the direction of the pump and changing the configuration of the valves at each step. The compressibility of the formation fluid/reagent mixture allows a piston to be moved during the pumping, inducing the mixing to take place as an agitator exposes the formation fluid to the reagent. It is noted, by using the subject matter disclosed to agitate the fluid mixture, a surface to volume ratio of the reagent to react or mix with the formation fluid can be significantly increased. After completion of the mixing, the fluid mixture can be pumped out of the chamber and into a flowline for measurement with other sensors, such as optics or resistivity.

Thus, the disclosed subject matter can improve reaction efficiency, reduce the operation time and increase mixing efficiency, among the other improvements and advantages over the prior art. Realtime downhole operations involving chemical reaction, fluid properties manipulation (viscosity, compound extraction), compound stripping can be enabled and can be enhanced by the disclosed subject matter in the application.

FIG. 1 shows a borehole logging tool 10 for testing earth formations and optionally analyzing the composition of fluids from the formation 14 in accord with invention is seen. As illustrated, the tool 10 is suspended in the borehole 12 from the lower end of a typical multi-conductor cable 15 that is spooled in the usual fashion on a suitable winch (not shown) on the formation surface. On the surface, the cable 15 is electrically connected to an electrical control system 18. The tool 10 includes an elongated body 19 which encloses the downhole portion of the tool control system 16. The elongated body 19 carries a probe 20 and an anchoring member 21 and/or packers (not shown in FIG. 1). The probe 20 is preferably selectively extendible as is the anchoring member 21 and they are respectively arranged on opposite sides of the body. The probe 20 is equipped for selectively sealing off or isolating selected portions of the wall of borehole 12 such that pressure or fluid communication with the adjacent earth formation is established. Also included with tool 10 is a fluid collecting chamber block 23.

Figure 2:
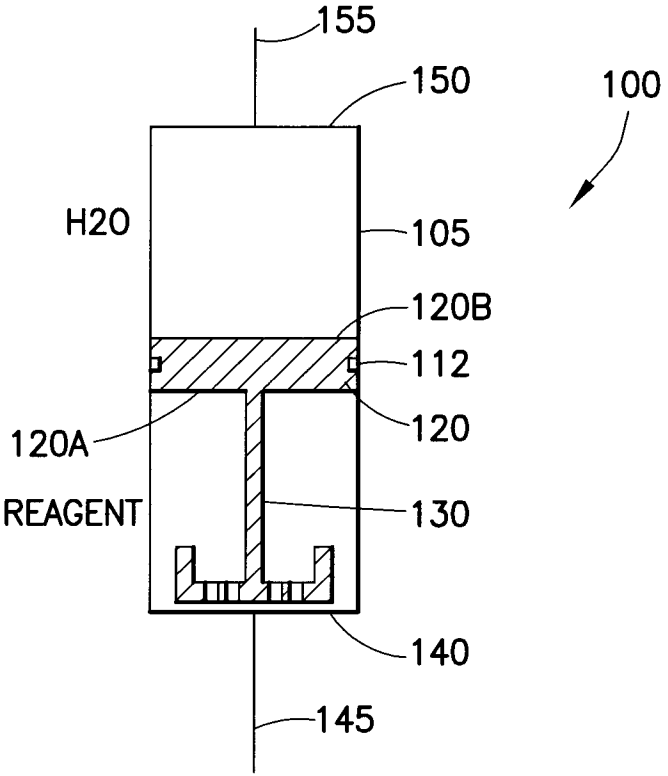
FIG. 2 shows the downhole mixing device, the downhole mixing device having a chamber with an agitating mixing element attached to a bottom surface of at least one piston used to mix reagent fluid with formation fluid, where the known volume of reagent fluid is introduced to contact the bottom surface of the piston through a first opening into the chamber and a third fluid is introduced through a second opening in the chamber to contact a top surface of the piston, wherein the third fluid places the at least one piston in a first position, according to the disclosed subject matter, according to embodiments of the disclosed subject matter.
Figure 3A:
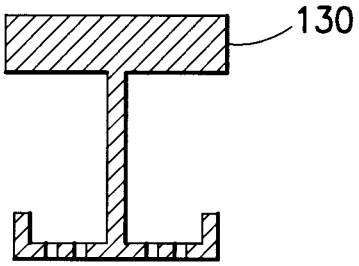
FIGS. 3A-3D shows multiple variations of the at least one agitator mixing device design within the at least one piston, wherein the at least one agitator mixing device is one of geometric shape such as a tree shaped, a T-shaped, a perforated cup with a shaft extending along vertical axis, a plurality of sequencing sized perforated cups varying from a smaller diameter to a larger diameter along a central axis, according to embodiments of the disclosed subject matter.
Figure 3B:
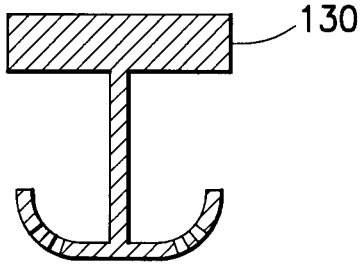
Figure 3C:
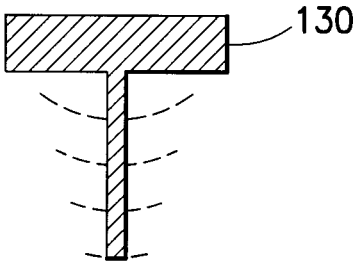
Figure 3D:
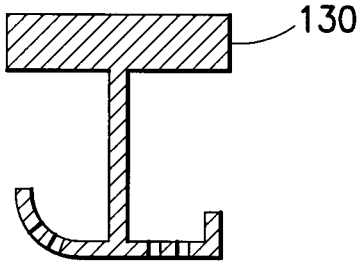

FIG. 2 shows at least one mixing device according to the disclosed subject matter. In particular, a mixing device (100) includes a chamber (105) having an opening (145) and at least one piston (120). The opening (145) can be for an inlet for a second fluid, such as a formation fluid. It is noted the formation fluid may be a gas, liquid or some combination thereof. Further, the chamber (105) includes a first end (140) and a second end (150), wherein the opening (160) appears exiting the second end (150). However, it is contemplated that the opening (145) may be located elsewhere along the outer perimeter of the chamber (105). It is also contemplated that there may be one or more openings, for example, one opening for an inlet of the second fluid and another inlet (not shown) for exiting of fluids such as the fluid mixture. The chamber (105) also shows an opening (155) for an actuating device (not shown) along the second end (150) of the chamber. However, it is contemplated that the opening (155) may be located elsewhere along the outer perimeter of the chamber (105). The actuating device (not shown) may be from a group consisting of one of: a device that pushes fluid to move piston (120); a mechanical device to move piston (120); or a compression related device that moves piston (120). It is noted that the actuating device actuates both in a direction toward the second end (150) of the chamber (105) as well as in a reverse direction toward the first end (140) of the chamber (105).

Still referring to FIG. 2, the piston (120) may include at least one sealing device (112) positioned between the piston (105) and the inside wall of the chamber (105). It is contemplated that the sealing device (112) may be from the group consisting of one of: an o-ring, an elastomeric device or a device that seals fluid from one location to another. Further, there may be two or more sealing devices (112) for the piston (120) (see FIG. 8). Further, the piston may have an top surface (120B) and bottom surface (120A).

Still referring to FIG. 2, the amount of first fluid introduced into the chamber is of particular interest for the operation of the mixing device. For example, a maximum volume of the first fluid, i.e., reagent fluid, must be calculated based upon many factors. In particular, the maximum volume of the first fluid should be based at least partially on the volume change upon compression of the second fluid, i.e., formation fluid. The piston (120) should be placed approximate in the middle of the chamber (105). Or in a formula (assuming that the temperature is constant):

$$P_1V_1=P_2V_2$$

With $P_1$, $V_1$, $P_2$ and $V_2$ being the pressure and volume of the compressible fluid before and after compression.
The expected volume change $\Delta V$ is then:

$$\Delta V = V_1 - V_2 = V_1 - \frac{P_1V_1}{P_2}$$

FIGS. 3A-3D show the piston (120) with different configurations of the agitator mixing device (130). For example, the agitator mixing device (130) can have a perforated portion with two arms extending away from a central portion, similar to a upside down shape of the letter T (see FIG. 3A). The agitator mixing device (130) can have a perforated portion with two arms extending away from a central portion, wherein the perforated arm portions are curved (see FIG. 3B). The agitator mixing device (130) can have one or more perforated curved portions (see FIG. 3C). The agitator mixing device (130) can have one or more perforated curved portions and linear portions (see FIG. 3D).

FIG. 4 shows that the chamber (105), at least one piston (120), the at least one agitator mixing device (130) or some combination thereof can include one or more coatings, i.e., chamber coating (170A), piston coating (170B) and the agitator mixing device (170C), such as at least one coating is capable for manipulation of the second fluid containing hydrogen sulfide ($H_2S$).

Figure 5:
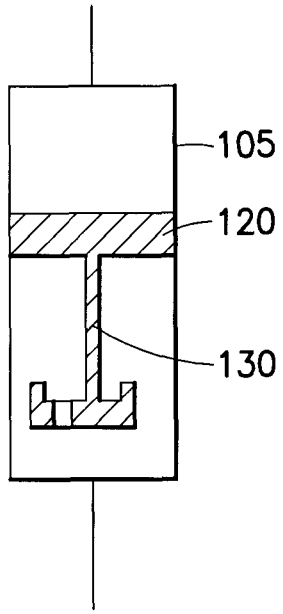
FIG. 5 shows the at least one agitator mixing device including at least two arm extensions from at least one extension, wherein at least one arm extension of the at least two arm extension is one of perforated, partially angled, or some combination thereof, according to embodiments of the disclosed subject matter.

FIG. 5 shows at least one agitator mixing device (130) can have at least a portion having one or more channels to assist in mixing the fluids.

Figure 6:
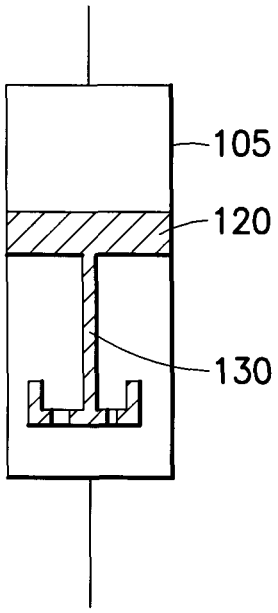
FIG. 6 shows the at least one agitator mixing device including a attachable/detachable agitator mixing device, according to embodiments of the disclosed subject matter.

FIG. 6 shows at least one agitator mixing device (130) can be one of unitary or detachable to the at least one piston (120)

Figure 7:
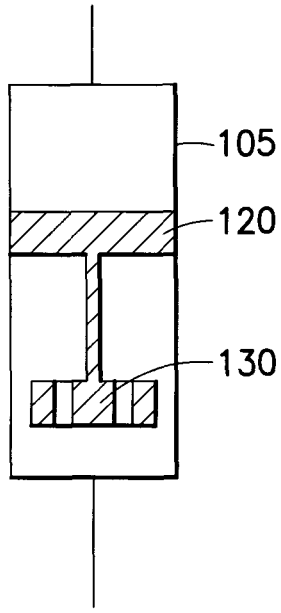
FIG. 7 shows the at least one agitator mixing device including one or more channels, according to embodiments of the disclosed subject matter.

FIG. 7 shows at least one agitator mixing device (130) can have at least a portion having two or more channels to assist in mixing the fluids.

Figure 8:
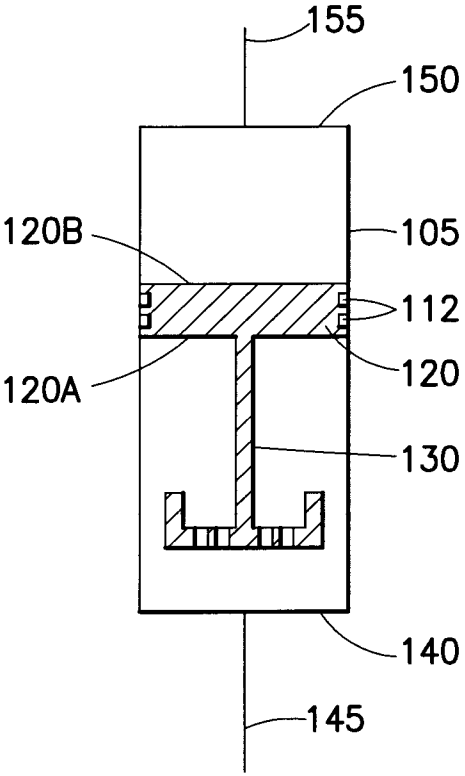
FIG. 8 shows the at least one agitator mixing device including two or more sealing devices, according to embodiments of the disclosed subject matter.

FIG. 8 shows at least one piston (120) may include two or more sealing devices (112) positioned between the piston (120) and the inside wall of the chamber (105).

Figure 9C:
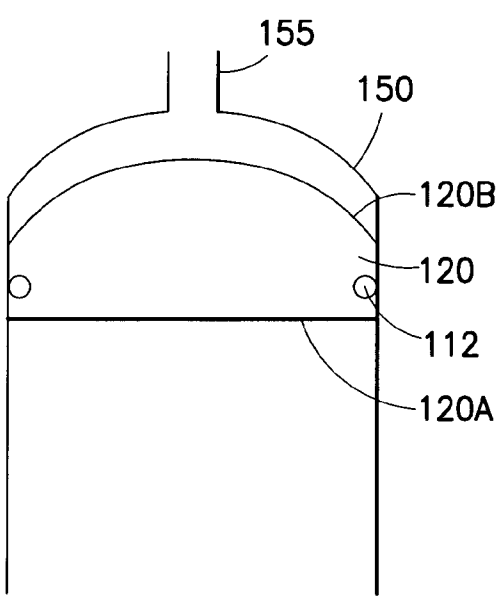
FIG. 9C shows a top surface of the piston being symmetrically formed to the second end of the chamber, wherein the shape is non-linear on the surface, according to embodiments of the disclosed subject matter.
Figure 9B:
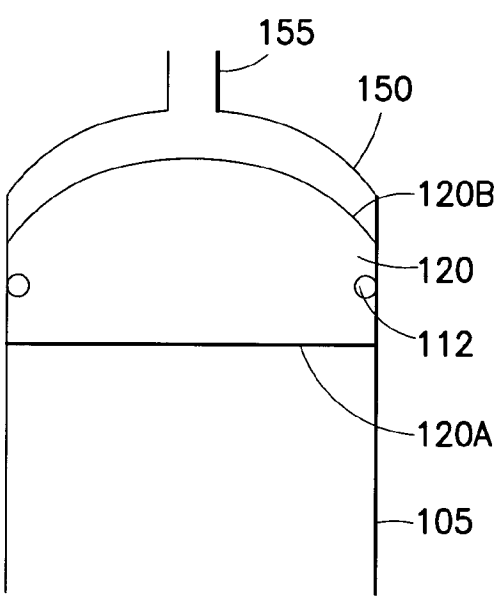
FIG. 9B shows a top surface of the piston being symmetrically formed to the second end of the chamber, wherein the shape has linear and non-linear portions on the surface, according to embodiments of the disclosed subject matter.
Figure 9A:
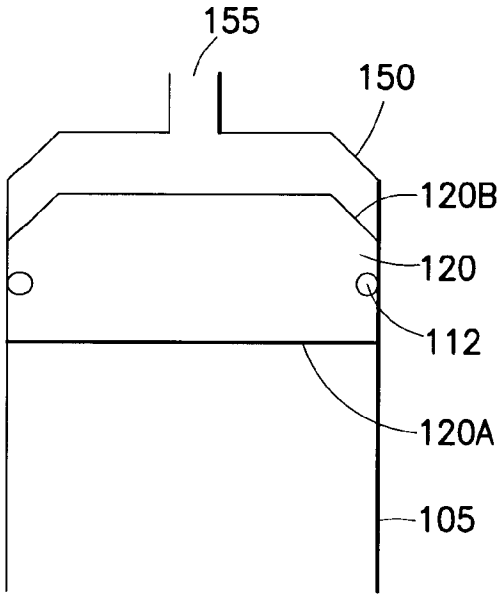
FIG. 9A shows a top surface of the piston being symmetrically formed to the second end of the chamber, wherein the shape has linear portions on the surface, according to embodiments of the disclosed subject matter.

Referring to FIGS. 9A, 9B and 9C, FIG. 9A shows a top surface (120B) of piston (120) linearly segmented and symmetrically formed to the second end (150) of the chamber (105). FIG. 9B shows a top surface (120B) of piston (120) linearly segmented, partially curved and symmetrically formed to the second end (150) of the chamber (105). FIG. 9C shows a top surface (120B) of piston (120) curved and symmetrically formed to the second end (150) of the chamber (105).

Figure 10:
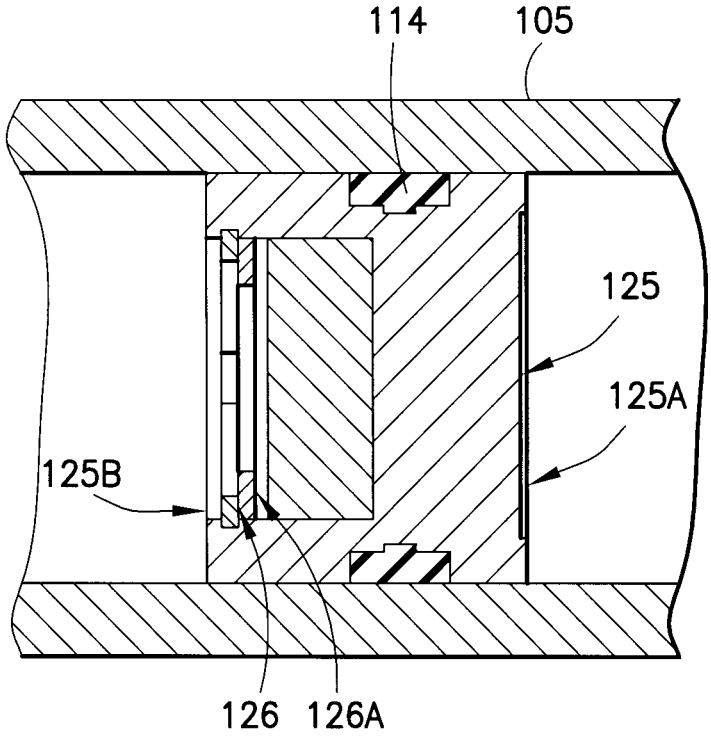
FIG. 10 shows an optional piston having a magnet with a magnet holder within the chamber, according to embodiments of the disclosed subject matter.

FIG. 10 shows only a second piston (125) of the at least one piston, wherein the second piston (125) is capable of contacting the top surface of the piston (120) and includes at least one magnet (126) to identify a location of the piston (120) during the mixing of the first fluid with the second fluid. Further, the second piston has a top surface (125B) and a bottom surface (125A), a magnet holder (126A) along with at least one sealing device (114).

Figure 11:
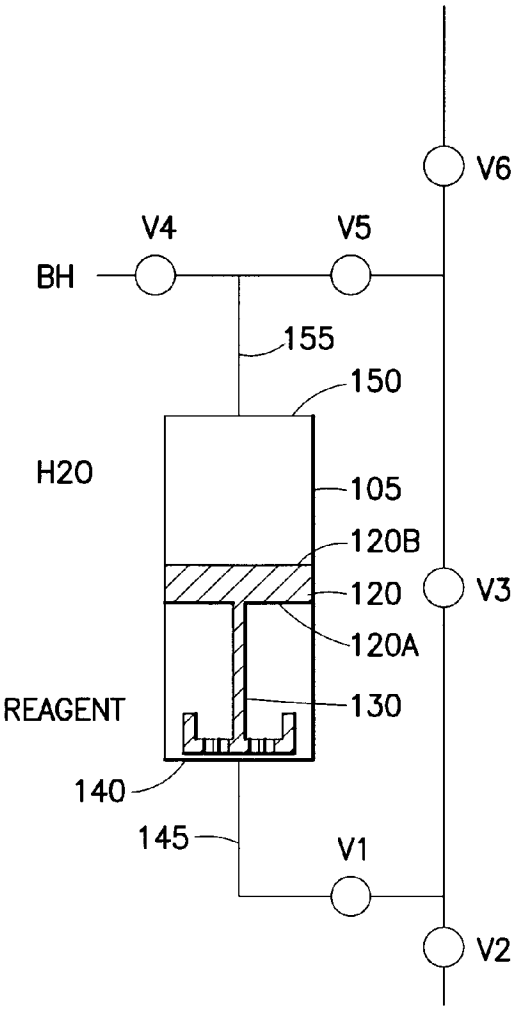
FIG. 11 shows the mixing device with a valve configuration arranged where the known volume of reagent fluid is introduced to contact the bottom surface of the piston through the first opening into the chamber and the third fluid is introduced through a second opening in the chamber to contact the top surface of the piston, wherein the third fluid places the at least one piston in a first position, according to embodiments of the disclosed subject matter.

FIG. 11 shows the mixing device (100) with a valve configuration (V1-V6) arranged where the known volume of reagent fluid is introduced to contact the bottom surface (120A) of the piston (120) through the first opening (140) into the chamber (105) and the third fluid is introduced through a second opening (155) in the chamber (105) to contact the top surface (150) of the piston, wherein the third fluid places the at least one piston (120) in a first position. For example, the piston (120) having valves, wherein V1, V2, V3, V4, V5 and V6 are part of the fluid delivery system. V1 and V2 are approximate the first end (140) of the chamber (105) and V3 is approximate a middle of the chamber (105). Further, V4, V5 and V6 are approximate the second end (150) of the chamber (105). It is contemplated that the valves V1-V6 may be positioned anywhere and not specifically as to the above noted locations. Further, it is possible there could be more valves than the valves disclosed above. Further still, V4 is a valve that can be in communication with the borehole (BH). Also, the portion of the chamber (105) in communication with the top surface (120B) of the piston (120) may be filled with a liquid, air or some combination thereof prior to entry of the second fluid. For example, the liquid may be water.

Figure 12:
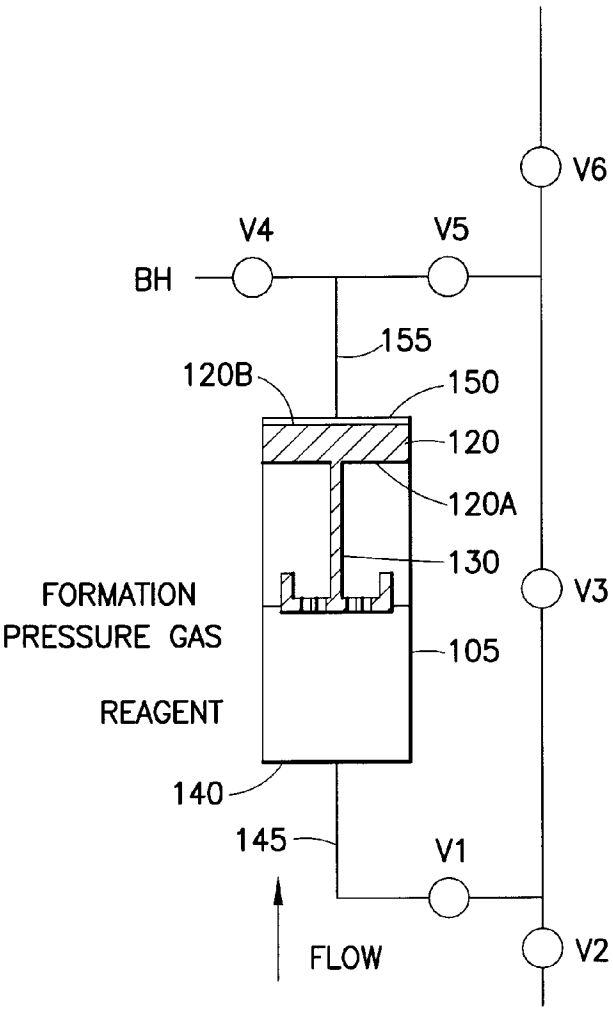
FIG. 12 shows the mixing device with the valve schematic arranged where a second fluid is supplied to the chamber from the first opening at a pressure that partially mixes the fluids and moves the at least one piston from the first position to a second position approximate the second end of the chamber, resulting in pushing the third fluid through the second opening and out of the chamber, according to embodiments of the disclosed subject matter.

FIG. 12 shows the mixing device (100) with the valve schematic (V1-V6) arranged where a second fluid is supplied to the chamber (105) from the first opening (145) at a pressure that partially mixes the fluids and moves the at least one piston (120) from the first position to a second position approximate the second end (150) of the chamber (105), resulting in pushing the third fluid through the second opening (155) and out of the chamber (105).

Figure 13:
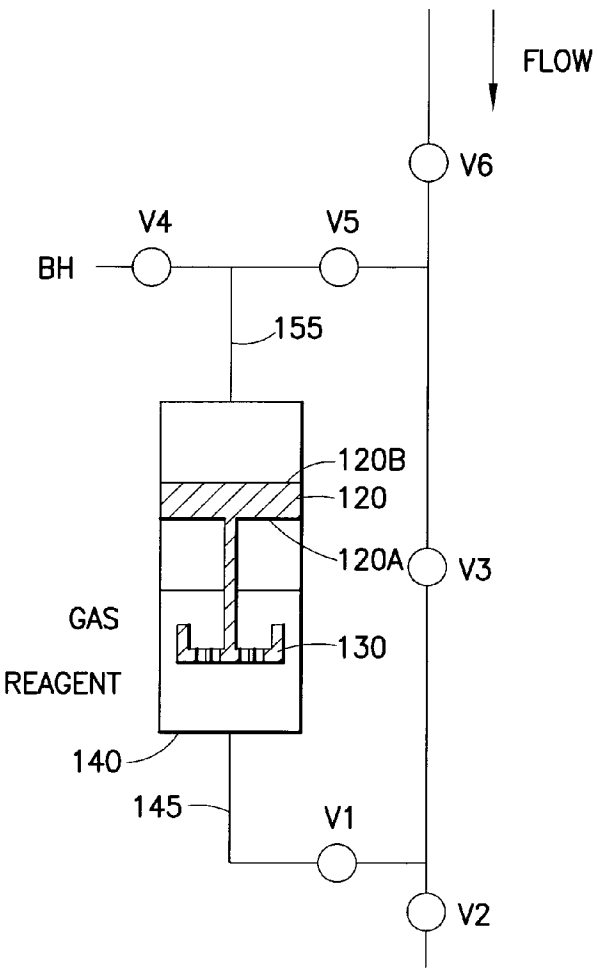
FIG. 13 shows the mixing device with the valve schematic arranged where a pumping device (not shown) of the fluid delivery system compresses the fluid mixture by applying a first pumping pressure to the top surface of the piston using the second fluid, moving the at least one piston in a direction from the second end toward the first end of the chamber, according to embodiments of the disclosed subject matter.

FIG. 13 shows the mixing device (100) with the valve schematic (V1-V6) arranged where a pumping device (not shown) of the fluid delivery system compresses the fluid mixture by applying a first pumping pressure to the top surface (120B) of the piston (120) using the third fluid, moving the at least one piston (120) in a direction from the second end (150) toward the first end (140) of the chamber (105).

Figure 14:
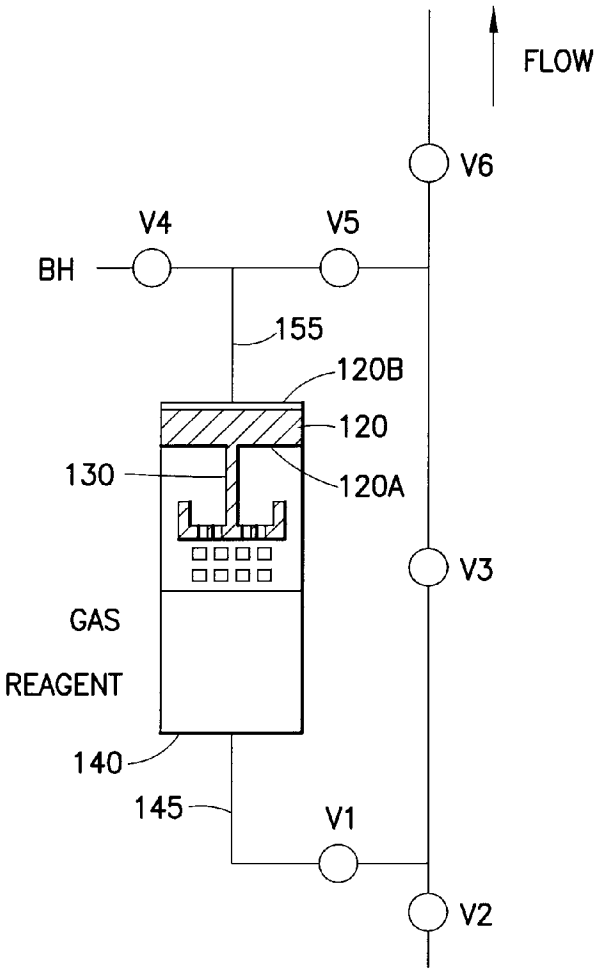
FIG. 14 shows the mixing device with the valve schematic arranged where the pumping device applies a second pumping pressure reversing the direction of movement of the at least one piston from the first end toward the second end of the chamber, wherein the movement of the at least one piston agitates the fluids with the at least one agitator mixing device so as to mix the first fluid with the second fluid, according to embodiments of the disclosed subject matter.

FIG. 14 shows the mixing device (100) with the valve schematic (V1-V6) arranged where the pumping device (not shown) that applies a second pumping pressure reversing the direction of movement of the at least one piston (120) from the first end (140) toward the second end (150) of the chamber (105), wherein the movement of the at least one piston (120) agitates the fluids with the at least one agitator mixing device (130) so as to mix the first fluid with the second fluid.

Figure 15:
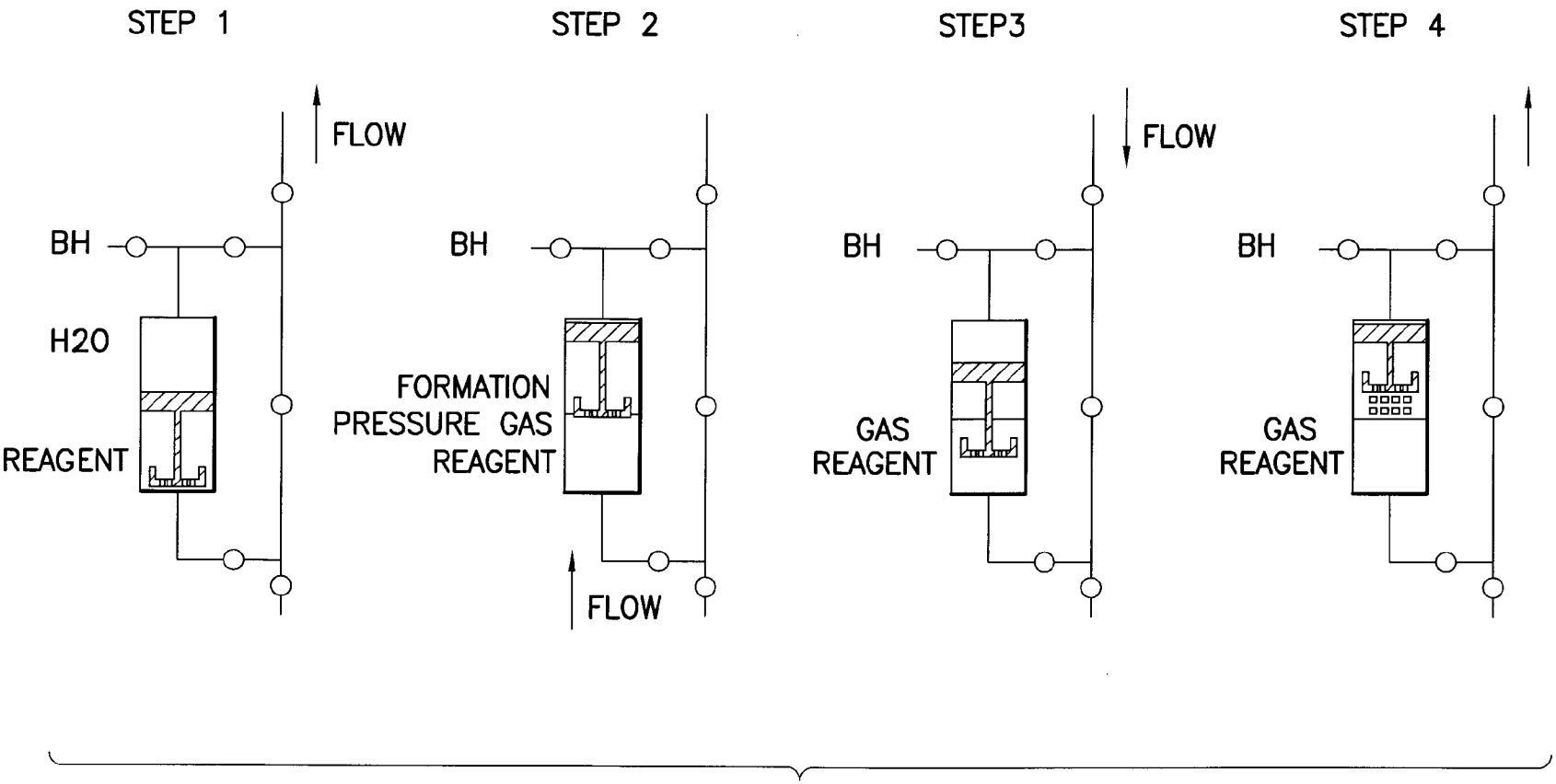
FIG. 15 illustrates sequenced steps of at least one method, according to embodiments of the disclosed subject matter in the application.

FIG. 15 illustrates sequenced steps of at least one method, in particular, four steps. Step 1 shows FIG. 11 as discussed above, Step 2 shows FIG. 12 as noted above, Step 3 shows FIG. 13 as discussed above and FIG. 14 shows the final step or FIG. 14 as noted above, such that steps 3 and 4 are repeated several times.

Further, while the present disclosed subject matter has been described with reference to an exemplary embodiment, it is understood that the words, which have been used herein, are words of description and illustration, rather than words of limitation. Changes may be made, within the purview of the appended claims, as presently stated and as amended, without departing from the scope and spirit of the present disclosed subject matter in its aspects. Although the present disclosed subject matter has been described herein with reference to particular means, materials and embodiments, the present disclosed subject matter is not intended to be limited to the particulars disclosed herein; rather, the present disclosed subject matter extends to all functionally equivalent structures, methods and uses, such as are within the scope of the appended claims.

What is claimed is:

1. A downhole mixing apparatus for mixing a first fluid with a second fluid, the downhole mixing apparatus comprising:

a chamber having a first end, a second end, a first opening that allows fluid to flow into the first end of the chamber, and a second opening that allows fluid to flow into the second end of the chamber;

at least one piston positioned within the chamber, wherein the piston (i) generates a seal between the first end and the second end of the chamber, (ii) is movable along the chamber towards the first end and towards the second end of the chamber, and (iii) comprises at least one agitator mixing device attached to a bottom surface of the at least one piston; and a fluid delivery system configured (i) to supply a volume of the second fluid to the chamber through the first opening and (ii) to move the piston inside the chamber so that the at least one agitator mixing device mixes the first fluid with the second fluid.

2. The downhole mixing apparatus of claim 1, wherein the first fluid is a reactant fluid for detecting at least one of $H_2S$, $CO_2$, and Hg within the second fluid.

3. The downhole mixing apparatus of claim 1, wherein the second fluid is a formation fluid.

4. The downhole mixing apparatus of claim 1, wherein the at least one agitator mixing device comprises at least one perforated portion.

5. The downhole mixing apparatus of claim 1, wherein the at least one agitator mixing device is at least one of tree-shaped, T-shaped, and cup-shaped.

6. The downhole mixing apparatus of claim 1, wherein the at least one agitator mixing device comprises a central portion extending from the bottom surface of the at least one piston and at least two arm extensions extending from the central portion.

7. The downhole mixing apparatus of claim 1, wherein the chamber, the at least one piston, the at least one agitator mixing device, or some combination thereof include one or more coatings.

8. The downhole mixing apparatus of claim 1, wherein the at least one agitator mixing device comprises (i) at least a portion having one or more channels to assist in mixing the fluids or (ii) at least a portion that is flexible.

9. The downhole mixing apparatus of claim 1, wherein the at least one agitator mixing device is unitary with the at least one piston.

10. The downhole mixing apparatus of claim 1, wherein the downhole mixing apparatus is used for at least one of gas scrubbing, a colorimetric sensing measurement, a electrochemical sensing measurement, and a magnetic resonance sensing measurement.

11. The downhole mixing apparatus of claim 1, wherein the fluid delivery system is in communication with a downhole tool having an inlet disposed on an exterior of the downhole tool for engaging a formation in a subterranean environment.

12. The downhole mixing apparatus of claim 1, further comprising:

a second piston capable of contacting the top surface of the at least one piston, wherein the second piston includes at least one magnet to identify a location of the at least one piston during the mixing of the first fluid with the second fluid.

13. The downhole mixing apparatus of claim 1, further comprising:

at least one sealing device for the at least one piston.

14. The downhole mixing apparatus of claim 1, wherein the fluid delivery system comprises a pumping device that (i) applies a first pumping pressure to the top surface of the piston using the second fluid and moves the at least one piston in a direction from the second end toward the first end of the chamber and (ii) applies a second pumping pressure reversing the direction of movement of the at least one piston from the first end toward the second end of the chamber.

15. The downhole mixing apparatus of claim 1, wherein a maximum volume of the first fluid within the chamber is based upon a volume change caused by compression of the second fluid.

16. The downhole mixing apparatus of claim 1, wherein the fluid delivery system is further configured (i) apply a pressure to the bottom surface of the piston using the second fluid so that the piston moves towards the second end of the chamber and (ii) to apply pressure to a top surface of the piston using a third fluid that is supplied through the second opening so that the piston moves towards the first end of the chamber.

17. The downhole mixing apparatus of claim 16, wherein the fluid delivery system comprises a plurality of valves in communication with each opening, wherein a first valve, a second valve, and a third valve are associated with the first opening and a fourth valve, a fifth valve, and a sixth valve are associated with the second opening.

18. The downhole mixing apparatus of claim 17, wherein the fluid delivery system comprises a pumping device that applies multiple pressures against the at least one piston, wherein a first pumping pressure directs the at least one piston toward the first end using the first valve, the second valve, and the third valve and a second pumping pressure directs the at least one piston in a reverse direction from the first end toward the second end of the chamber using the third valve, the fourth valve, the fifth valve, and the sixth valve.

19. The downhole mixing apparatus of claim 16, wherein the fluid delivery system comprises an actuating device.

20. The downhole mixing apparatus of claim 19, wherein the actuating device is at least one of a mechanical actuating device and a pumping device.

21. A downhole mixing method for mixing a first fluid with a second fluid within a chamber that comprises a first end, a second end, a first opening, and at least one piston with at least one agitator mixing device attached to a bottom surface of the piston, the downhole mixing method comprising:

(a) supplying the second fluid to the first end of the chamber through the first opening to move the piston towards the second end of the chamber, wherein the first fluid is loaded within the first end of the chamber;

(b) moving the piston in a direction from the second end toward the first end of the chamber;

(c) moving the piston in a reverse direction from the first end toward the second end of the chamber; and (d) repeating steps (b) and (c) one or more times to mix the first fluid and the second fluid using the agitator mixing device.

22. The downhole mixing method of claim 21, wherein the chamber is housed within a downhole tool.

23. The downhole mixing method of claim 21, wherein the first fluid and the second fluid are mixed to form a homogenous fluid.

24. The downhole mixing method of claim 21, wherein a maximum volume of the first fluid is based upon a volume change caused by compression of the second fluid.

25. The downhole mixing method of claim 21, wherein the first fluid is a reagent fluid and the second fluid is a formation fluid.

26. The downhole mixing method of claim 21, wherein steps (b), (c), and (d) provide for a compound extraction or a compound stripping of the second fluid by the first fluid.

27. The downhole mixing method of claim 21, wherein the second fluid is a formation fluid that is one of a gas, a liquid, or some combination thereof.

28. The downhole mixing method of claim 21, wherein the at least one piston comprises at least one sealing device.

29. The downhole mixing method of claim 21, wherein the chamber, the at least one piston, the at least one agitator mixing device, or some combination thereof are coated with one or more coatings.

30. The downhole mixing method of claim 21, wherein a fluid delivery system performs steps (a) through (d).

31. The downhole mixing method of claim 30, wherein the fluid delivery system is in communication with a downhole tool having an inlet disposed on an exterior of the downhole tool for engaging a formation in a subterranean environment.

32. The downhole mixing method of claim 30, wherein, at step (b), the fluid delivery system applies pressure to a top surface of the at least one piston using a third fluid that is supplied through a second opening within the chamber so that the piston moves towards the first end of the chamber.

33. The downhole mixing method of claim 32, wherein the fluid delivery system has a plurality of valves in communication with each opening, wherein a first valve, a second valve, and third valve are associated with the first opening, and a fourth valve, a fifth valve, and a sixth valve are associated with the second opening.

34. The downhole mixing method of claim 33, wherein the fluid delivery system comprises a pumping device that applies multiple pressures against the at least one piston so that a first pumping pressure directs the at least one piston toward the first end using the first valve, the second valve, and the third valve and a second pumping pressure directs the piston in a reverse direction from the first end toward the second end of the chamber using the third valve, the fourth valve, the fifth valve, and the sixth valve.

* * * * *